US005363826A

United States Patent [19]

Takaoka

[11] Patent Number: 5,363,826

[45] Date of Patent: Nov. 15, 1994

[54] AIR-FUEL RATIO CONTROL APPARATUS FOR AN INTERNAL COMBUSTION ENGINE

[75] Inventor: Toshio Takaoka, Toyota, Japan

[73] Assignee: Toyota Jidosha Kabushiki Kaisha, Toyota, Japan

[21] Appl. No.: 15,790

[22] Filed: Feb. 10, 1993

[30] Foreign Application Priority Data

Feb. 14, 1992 [JP] Japan ..... 4-028198

[51] Int. Cl.[5] ..... F02D 41/04

[52] U.S. Cl. ..... 123/486

[58] Field of Search ..... 123/486, 480, 478

[56] References Cited

U.S. PATENT DOCUMENTS

| | | | |
|---|---|---|---|
| 4,332,226 | 6/1982 | Nomura et al. | 123/478 |
| 4,587,938 | 5/1986 | Kobayashi et al. | 123/480 |
| 4,594,984 | 6/1986 | Raff et al. | 123/681 |
| 4,809,501 | 3/1989 | Kayanuma et al. | 60/274 |
| 5,016,595 | 5/1991 | Kawai et al. | 123/478 |
| 5,190,008 | 3/1993 | Yamasaki et al. | 123/486 |

FOREIGN PATENT DOCUMENTS

| | | |
|---|---|---|
| 59-7741 | 1/1984 | Japan . |
| 62-199943 | 9/1987 | Japan . |
| 3-242442 | 10/1991 | Japan . |
| 2173924 | 10/1986 | United Kingdom . |

OTHER PUBLICATIONS

Okano, Hiroshi; "Lean Burn Gasoline Engine" Paper at Symposium of Japanese Society of Automobile Technology on Feb. 21, 1992.

Patent Abstract of Japan, vol. 12 No. 120 (M685) Apr. 1988 Re JP-A 62-247142.

*Primary Examiner*—Andrew M. Dolinar

*Attorney, Agent, or Firm*—Cushman, Darby & Cushman

[57] ABSTRACT

An apparatus for controlling an air-fuel ratio in a lean burn internal combustion engine, such that three different air-fuel ratio zones are set, the three zones being an ultra lean zone with a low load, a medium lean zone with a medium load, and a non-lean zone with a high load. When the engine is under low load conditions, a map FLEANPM is selected to obtain an ultra lean air-fuel ratio based on detected intake pressure PM values and engine speed NE. When the engine is under medium load conditions, a map FLEANTA is selected to obtain a medium lean air-fuel ratio based on a detected throttle opening values TA and engine speed NE. When the engine is under high load, conditions the lean correction control is canceled, thereby obtaining a theoretical air-fuel ratio or an air-fuel ratio smaller than the theoretical air-fuel ratio, and when the engine remains at a point in the medium lean zone, the air-fuel ratio decreases gradually toward the theoretical air-fuel ratio as time elapses.

10 Claims, 13 Drawing Sheets

ROUTINE FOR CALCULATING FLEAN
90
HAS LEAN CONDITION OBTAINED ?
NO
YES
CALCULATE FLEANPM FROM PM AND NE
PM
FLEANPM
NE
94
96
TA≧f(NE) ?
NO
YES
102
98
92
FLEAN1=0
FLEAN =1.0
CALCULATE FLEANTA FROM TA AND NE
TA
FLEANTA
NE
106
FLEAN1i-1 = FLEAN1
104
FLEAN1 = max(FLEANTA, FLEAN1i-1 + K)
100
FLEAN = max(FLEAN1, FLEANPM)
RETURN

ROUTINE FOR CALCULATING FLEAN

HAS LEAN CONDITION OBTAINED ?
120
NO
YES
CALCULATE FLEANPM1 FROM PM AND NE
PM
FLEANPM1
NE
121
122
FLEAN=1.0
124
TA≧f'(NE) ?
NO
YES
126
132
CALCULATE FLEANTA FROM TA AND NE
TA
FLEANTA
NE
CALCULATE FLEANPM2 FROM PM AND NE
PM
FLEANPM2
NE
128
134
FLEANST = max(FLEANTA, FLEANST i-1 + K)
FLEANST = max(FLEANPM2, FLEANST i-1 + KFL)
1
2

AIR-FUEL RATIO CONTROL APPARATUS FOR AN INTERNAL COMBUSTION ENGINE

BACKGROUND OF THE INVENTION

1. Field of the Invention

The present invention relates to an air fuel ratio control system for an internal combustion engine, wherein the engine operates, in accordance with the load of the engine, between a combustible mixture of lean air fuel ratio and a combustible mixture of theoretical or rich air fuel ratio mixture.

2. Description of Related Art

A so-called "lean burn internal combustion engine" is known, where the engine, under low load conditions, is operated by supplying a lean air fuel mixture having an air fuel ratio as high as, for example, 20.0. In such a known internal combustion engine, under high engine load conditions, where high engine output power is required, the engine is supplied with an air fuel mixture having a theoretical air fuel ratio or a rich air fuel mixture having an air fuel ratio with a value smaller than the theoretical air fuel ratio. Under low load conditions, where the engine is supplied by a lean air fuel ratio that is higher than a theoretical air fuel ratio, a basic fuel injection amount is first calculated to be an amount of fuel capable of obtaining the theoretical air fuel ratio under particular engine operating conditions determined by a combination of an engine speed value and an intake pressure value or a ratio of the intake air amount to the engine speed, and a lean correction factor ($<1.0$) is multiplied to the calculated basic injected fuel amount to obtain a final fuel amount to be injected to an intake system of the internal combustion engine from respective injectors. Correcting the basic injected fuel amount by multiplying the lean correction factor by the basic fuel amount produce a lean air fuel mixture that is suitable under particular engine operating conditions.

A determination of the value of the lean correction factor for obtaining an ultra lean air fuel mixture in accordance with the value of the intake pressure and generating no torque increase can be obtained irrespective of a depression of the accelerator pedal to a degree of throttle valve opening larger than a predetermined value, where the value of the intake pressure is substantially maintained and unchanged irrespective of depression of the accelerator pedal. In order to obtain a necessary increase in engine torque upon depression of the accelerator pedal, the air fuel ratio of the air fuel mixture introduced into the engine is changed from a lean air fuel ratio value to a theoretical air fuel ratio. Such a change in the air fuel ratio from a lean air fuel ratio (a large air fuel ratio value) to a theoretical air fuel ratio causes the engine torque to abruptly increase, thereby generating a shock in the engine. In order to prevent such a rapid increase in torque, a second map is made for calculating a lean correction factor based on a combination of throttle valve opening degree values and engine rotational speed. This second map is used for calculating the lean correction factor at an engine load area operating with an intermediate lean air fuel mixture, which is located between a value of the engine load above, with the value of the intake pressure not substantially varying irrespective of depression of the accelerator pedal and another engine load value, above which the engine operates with a theoretical air fuel ratio. The setting of the air-fuel ratio at this intermediate lean area is, for example, between about 16.0 and 18.0. See Japanese Un-Examined Patent Publication (kokai) No. 3-24244.

In the prior art, under low engine load conditions, an ultra lean air fuel mixture of an air fuel ratio as high as, for example, 18.0 to 20.0 is obtained for reducing the amount of nitrogen oxide emission in the exhaust gas. Under middle load conditions, an intermediate lean air fuel mixture of an air fuel ratio in a range, for example, between about 16.0 and 18.0 is obtained in response to a slight increase in engine output power. Under high load conditions, the engine is operated under a theoretical air fuel ratio or an air fuel ratio slightly richer than the theoretical air-fuel ratio. The provision of a medium lean air fuel ratio area between the ultra lean air fuel ratio area and the rich air fuel ratio area permits a smooth increase in engine output torque along the entire load range of the engine, while preventing the occurrence of shock caused by acceleration of the vehicle.

However, the intermediate lean air fuel ratio can generate a large amount of nitrogen oxide in the exhaust gas, and as a result, when the engine is operating in a mode such that it remains with in the intermediate air fuel ratio zone, there is a large amount of nitrogen oxide emission in the exhaust gas which is not suitable in view of recent environmental restrictions concerning emission of nitrogen gas in the exhaust gas of internal combustion engines.

SUMMARY OF THE INVENTION

An object of the present invention is to provide an intake system capable of preventing the emission of NOx from increasing even when the engine remains in the medium lean zone and maintains a smooth increase in engine torque.

According to the present invention, an intake system is provided for an internal combustion engine, comprising:

- an intake passageway for the introduction of intake air into the engine;
- a throttle valve arranged in the intake passageway for controlling the amount of intake air into the engine;
- a fuel supply device for supplying a fuel which, together with the intake air, is a combustible mixture to be introduced into the engine for combustion thereat;
- means for setting a desired air fuel ratio of the air-fuel mixture for the engine, and;
- means for controlling the fuel amount by said fuel supply device for obtaining the air fuel ratio set by the setting means,
- said setting means comprising;
- means for detecting the load of the internal combustion engine;
- first setting means for setting the air fuel ratio to ultra lean under a low load is acting the engine such that an emission of nitrogen oxide components in the exhaust gas is small;
- second setting means for setting the air fuel ratio to medium lean, which varies from the air fuel ratio that is ultra lean to an air fuel ratio other than a lean air fuel ratio in accordance with an increase in the load during a medium load, wherein the medium load is larger than a load at the upper limit in the ultra lean zone and smaller than the maximum load when a lean air fuel ratio operation is possible;

third setting means for setting an air fuel ratio other than a lean air fuel ratio when a load of the engine is larger than a medium load;

means for selecting, in accordance with a load of the engine as detected, a desired selection between the first, second and third setting means, and;

means, upon selecting the second setting means and remaining at a location in the medium lean air fuel ratio zone, for gradually reducing the air fuel ratio toward the air fuel ratio other than a lean air fuel ratio.

BRIEF DESCRIPTION OF ATTACHED DRAWINGS

Figure 8A:
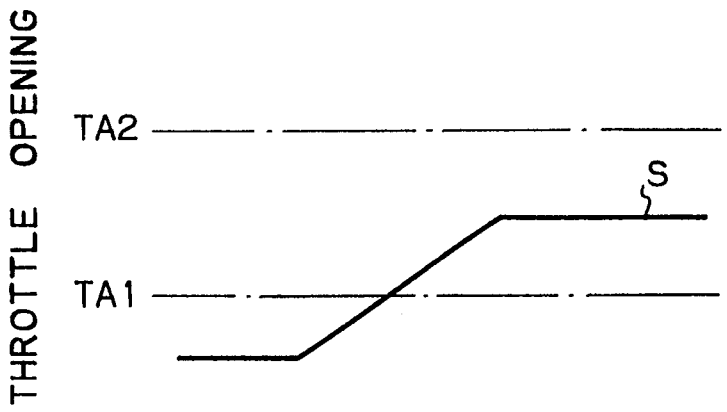

FIGS. 8-(A) and (B) illustrate changes in the degree of opening of the throttle valve and the air fuel ratio with respect to a lapse of time during acceleration.

Figure 9:
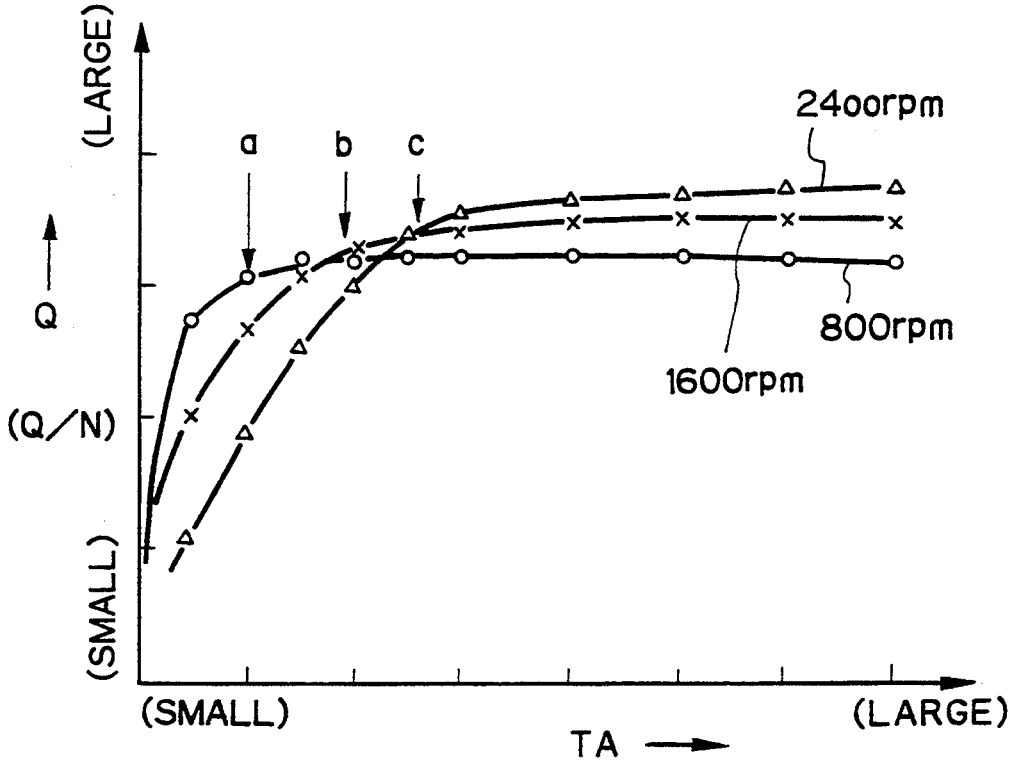

FIG. 9 show the relationship between the degree of opening of the throttle value and the intake air amount.

Figure 10:
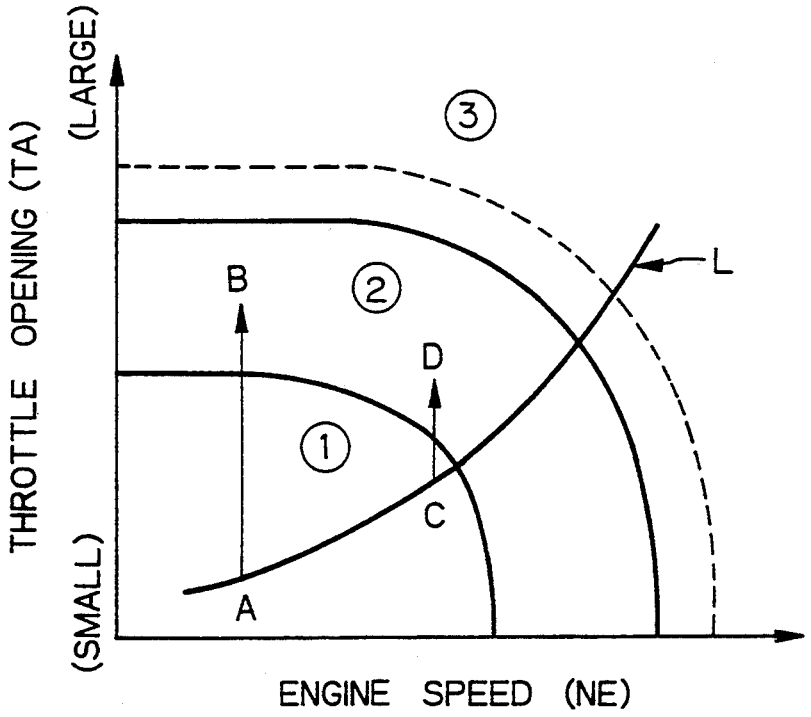

FIG. 10 illustrates a relationship between the degree of opening of the throttle valve and the engine speed on a load line using the 5th speed gear of the transmission.

Figure 11:
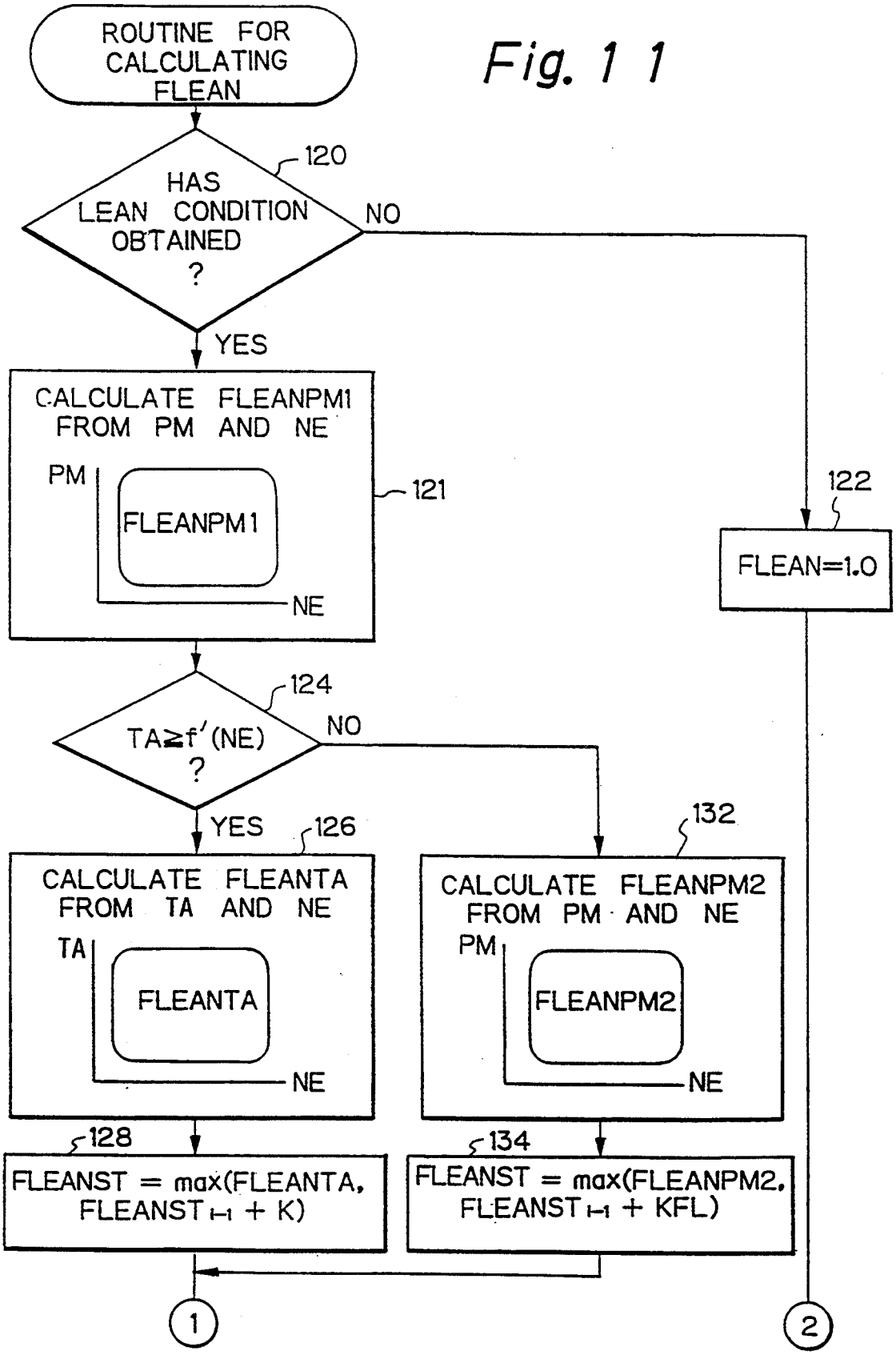
Figure 12:
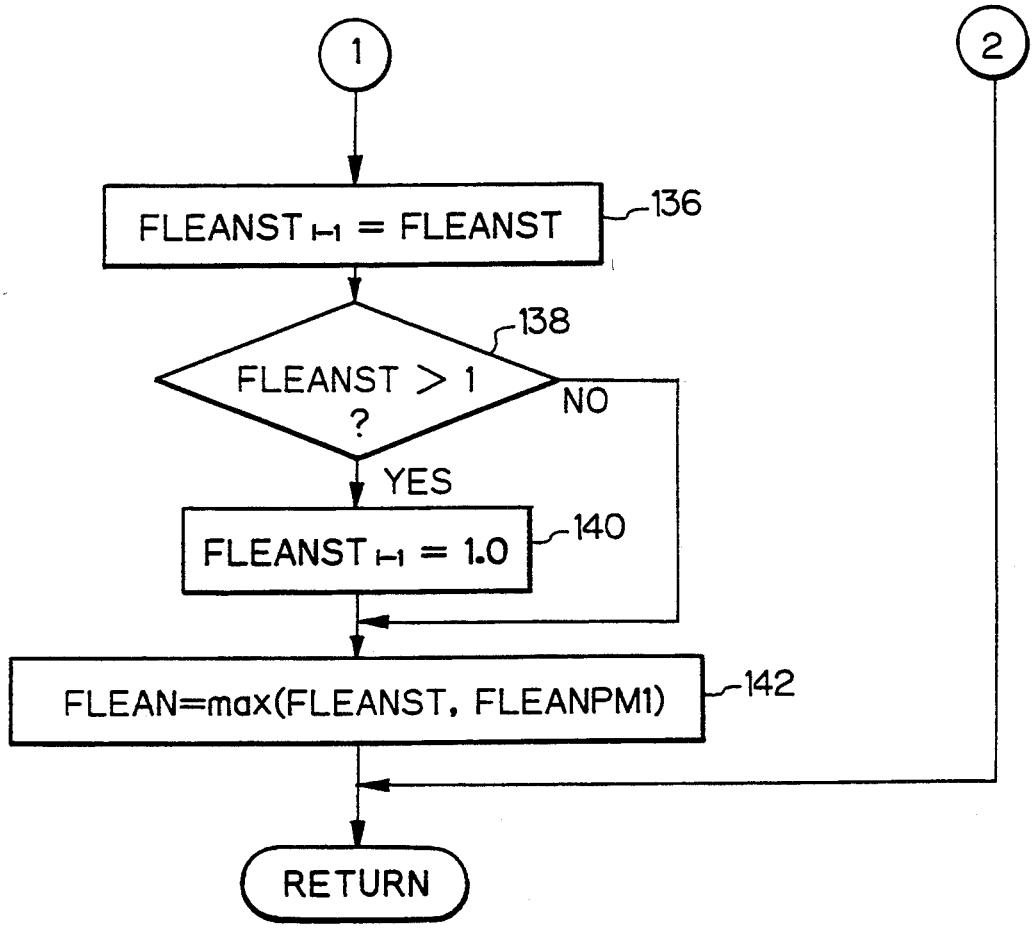

FIG. 11 and 12 show a routine for calculating a lean correction factor according to a second embodiment of the present invention.

Figure 2:
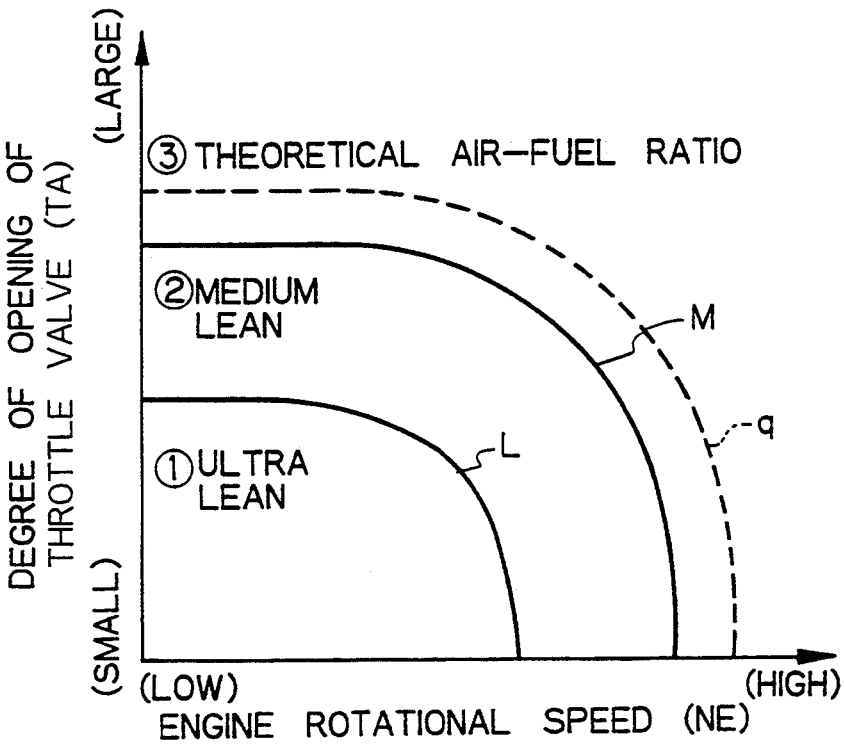
FIG. 2 is an illustration of a setting of an air fuel ratio with respect to engine rotational speed and the degree of opening the throttle valve.
Figure 13:
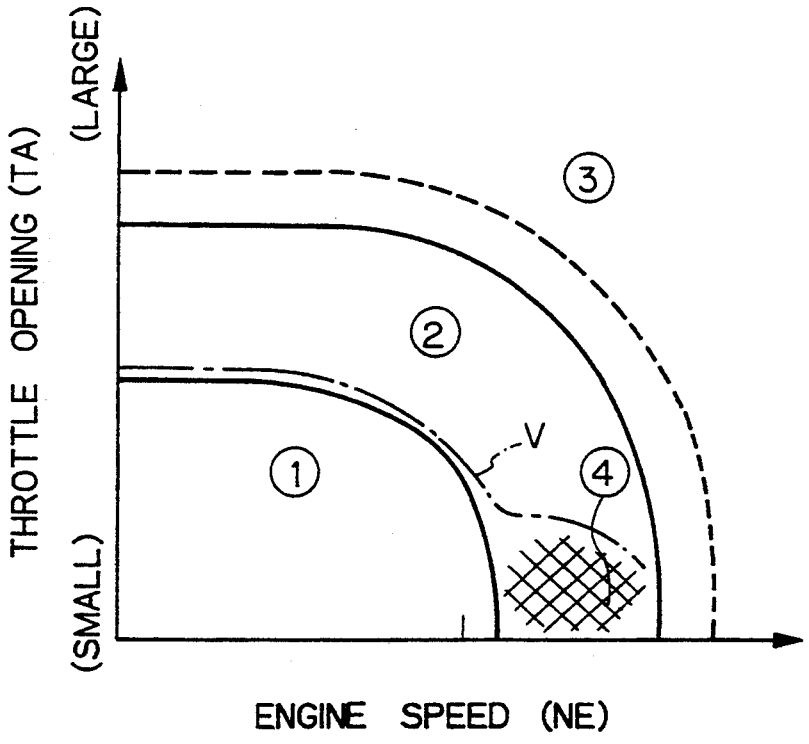

FIG. 13 is similar to FIG. 2, but shows a setting of the air fuel ratio in the second embodiment.

DESCRIPTION OF PREFERRED EMBODIMENTS

Figure 1:
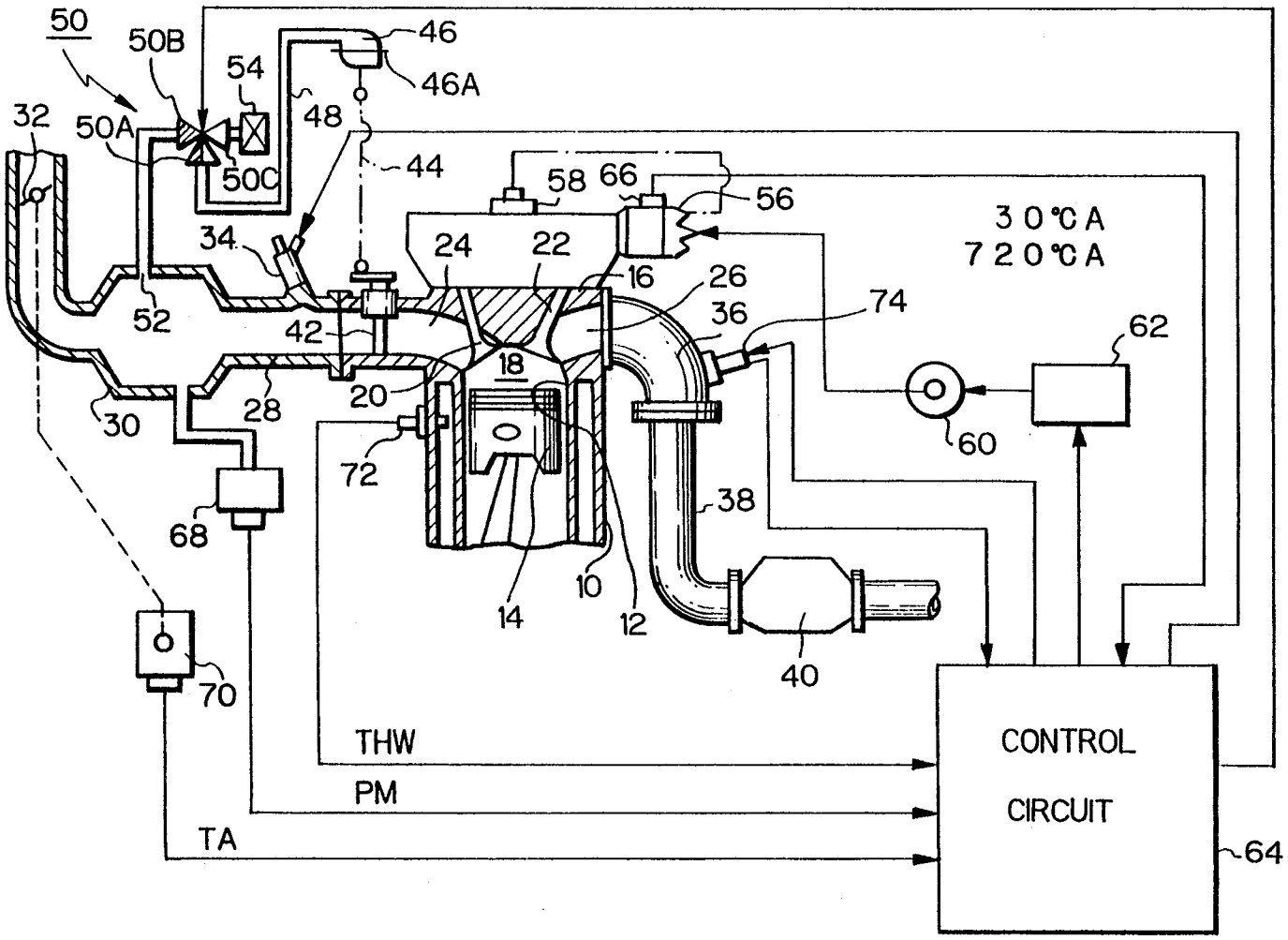
FIG. 1 is a schematic view of an the internal combustion engine according to the present invention.

In FIG. 1, a reference numeral 10 denotes a cylinder block, in which a cylinder bore 12 is formed. A piston 14 is slidably arranged in the cylinder bore 12. A cylinder head 16 is connected to the cylinder block 10. A combustion chamber 18 is created between the cylinder block 10, the piston 14 and the cylinder head 16. An intake valve 20 and an exhaust valve 22 are mounted to the cylinder head 16. The cylinder head 16 forms an intake port 24 and an exhaust port 26, which are opened or closed by the intake valve 20 and the exhaust valve 22, respectively. The intake port 24 is connected, via an intake pipe 28 and a surge tank 30, to a throttle valve 32. A fuel injector 34 is connected to the intake pipe 28 for creating a flow of fuel injected toward the respective intake port 24. The exhaust port 26 is connected to an exhaust manifold 36, which is connected, via an exhaust pipe 38, to a catalytic converter 40.

A swirl control valve (SCV) 42 is arranged in the intake port 24. As well known, the swirl control valve 42 is in a closed position so as to throttle the flow of intake air introduced into the combustion chamber 18 so as to create a swirl movement of the intake air in the combustion chamber 18 during low load engine conditions, allowing a lean air fuel mixture to be burnt under stable conditions. The swirl control valve 42, during high load engine conditions, moves from the closed position to an open position so that the throttling is canceled and a straight flow of intake air into the combustion chamber 18 is created. In this case, an air fuel mixture of a theoretical air fuel ratio or an air fuel ratio smaller than the theoretical air fuel ratio is supplied to the combustion chamber 18. The swirl control valve 42 is connected, vial a link 44, to diaphragm type actuator 46 at its diaphragm 46A. Vacuum pressure displaces the diaphragm 46A, causing the swirl control valve 42 to move between the closed position and the open position. Namely, in order to control the pressure at the diaphragm 46A, a three port two position electromagnetic valve 50 is provided, which has a first or common port 50A connected to the diaphragm 46A, a second port 50B connected to a vacuum taking out port 52 formed at the surge tank 30, and a third port 50C connected to an air filter 54. The electromagnetic valve 50 is switched between a first position where the first port 50A is connected to the second port 50B so that the diaphragm 46A is opened to the intake pressure at the surge tank 30, and a second portion where the first port 50A is connected to the third port 50C for opening the atmospheric pressure to the diaphragm 46A.

A reference numeral 56 denotes a distributor, and 58 represents an ignition plug. The distributor 56 is connected to the ignition coil 60, which is connected to an ignitor 62 for generating an ignition pulse signal applied, via the distributor 60, to a desired ignition plug 58.

A reference numeral 64 denotes a control circuit constructed as a microcomputer system. The control circuit 64 receives signals from various sensors for the detection of engine operating conditions for calculating the amount of fuel to be injected from the injectors 34 for obtaining a desired air-fuel ratio. A crank angle sensor arrangement 66 is provided on the distributor 56 for issuing first pulse signals for every 30 degree rotation of the crankshaft (not shown) of the engine, and second pulse signals for every 720 degree rotation (one complete cycle of the engine) of the crankshaft. These first and second signals are supplied to the control circuit 64. An intake pressure sensor 68 is connected to the surge tank 30 for obtaining a signal indicative of the intake pressure PM at the surge tank 30, which is supplied to the control circuit 64. A throttle sensor 70 is connected to the pivoting shaft of the throttle valve 32 for obtaining a signal indicative of the degree of opening TA the throttle valve 32, which is supplied to the control circuit 64. In addition, an engine cooling water temperature sensor 72 is mounted to the engine body 10 so that it makes contact with the engine cooling water in an engine cooling water jacket in the engine body 10 for issuing a signal indicative of the temperature THW of the cooling water, and a air fuel ratio sensor 74 is mounted on the exhaust manifold 36 so that it makes contact with the flow of exhaust gas in the exhaust manifold for obtaining a signal indicative of the air-fuel ratio of the combustible mixture supplied to the engine from the intake system.

The control circuit 64 is for controlling the amount of fuel injected from the fuel injectors 34 of the respective cylinders of the engine for obtaining a desired value of the air fuel ratio. FIG. 2 illustrates a setting as to how an air fuel ratio is determined in accordance with engine rotational speed NE and the degree of opening TA the throttle valve 32. At a low load area 1 as circled inside line L, with a low engine speed and small degree of throttle opening, an ultra lean combustible mixture is obtained, i.e., the values of the air-fuel ratio are in a range, for example, between about 18.0 to about 20.0. At a medium load area 2 as circled, between lines L and M, with a medium engine speed and medium degree of throttle opening, a medium lean combustible mixture is obtained, i.e., the values of the air-fuel ratio are in a range, for example, between 16.0 to 18.0. At a high load area 3 as circled externally outside the line M, with a high engine speed and large degree of throttle opening, a non-lean combustible mixture is obtained, i.e., the value of the air-fuel ratio is the theoretical air fuel ratio (about 14.0) or an air fuel ratio smaller than the theoretical air fuel ratio.

At the zone 1, the amount of intake air increases proportionally as the degree of opening TA the throttle valve 32 increases, so that the lean correction factor FLEAN (<1.0), which is multiplied to the basic fuel amount TP, is used to obtain an ultra lean air fuel mixture of a desired air-fuel ratio value. As will be described later, a map of values for the lean correction factor FLEAN with respect to combinations of values of intake pressure PM and engine speed NE is provided to obtain desired values of the air-fuel ratio at the ultra lean air-fuel mixture zone 1. A well known map interpolation calculation is carried out to obtain a desired value of the lean correction factor FLEAN in a combination of a detected intake pressure value PM and a detected engine speed value NE.

At the zone 2, depression of the accelerator pedal does not correspondingly increase the intake air amount. If the lean correction factor FLEAN were calculated from the map based on the intake pressure, a smooth increase in engine torque cannot be obtained, thereby a shock is generated when the engine enters a full load zone when the setting of the air fuel ratio is the theoretical air-fuel ratio or an air-fuel ratio smaller than the theoretical air-fuel ratio (rich air-fuel mixture). Therefore, according to the present invention, in order to obtain a smooth change in air-fuel ratio in accordance with depression of the accelerator pedal, a lean correction factor FLEAN is calculated in accordance with a combination of the degree of opening TA the throttle valve 32 and the engine speed NE. Namely, a map of values of lean correction factor FLEAN with respect to combinations of values of the degree of opening TA the throttle valve 32 and the engine speed NE is provided to obtain desired values of the air-fuel ratio at the medium lean air-fuel mixture zone 2. A well known map interpolation calculation is also carried out to obtain a desired lean correction factor value FLEAN in a combination of a detected value of the degree of opening TA the throttle valve 32 and a detected engine speed valve NE.

The zone 3 is an area out of the lean combustion operation, and therefore, the engine is operated under the theoretical air fuel ratio or an air fuel ratio smaller than the theoretical air fuel ratio (rich air-fuel mixture).

Figure 3:
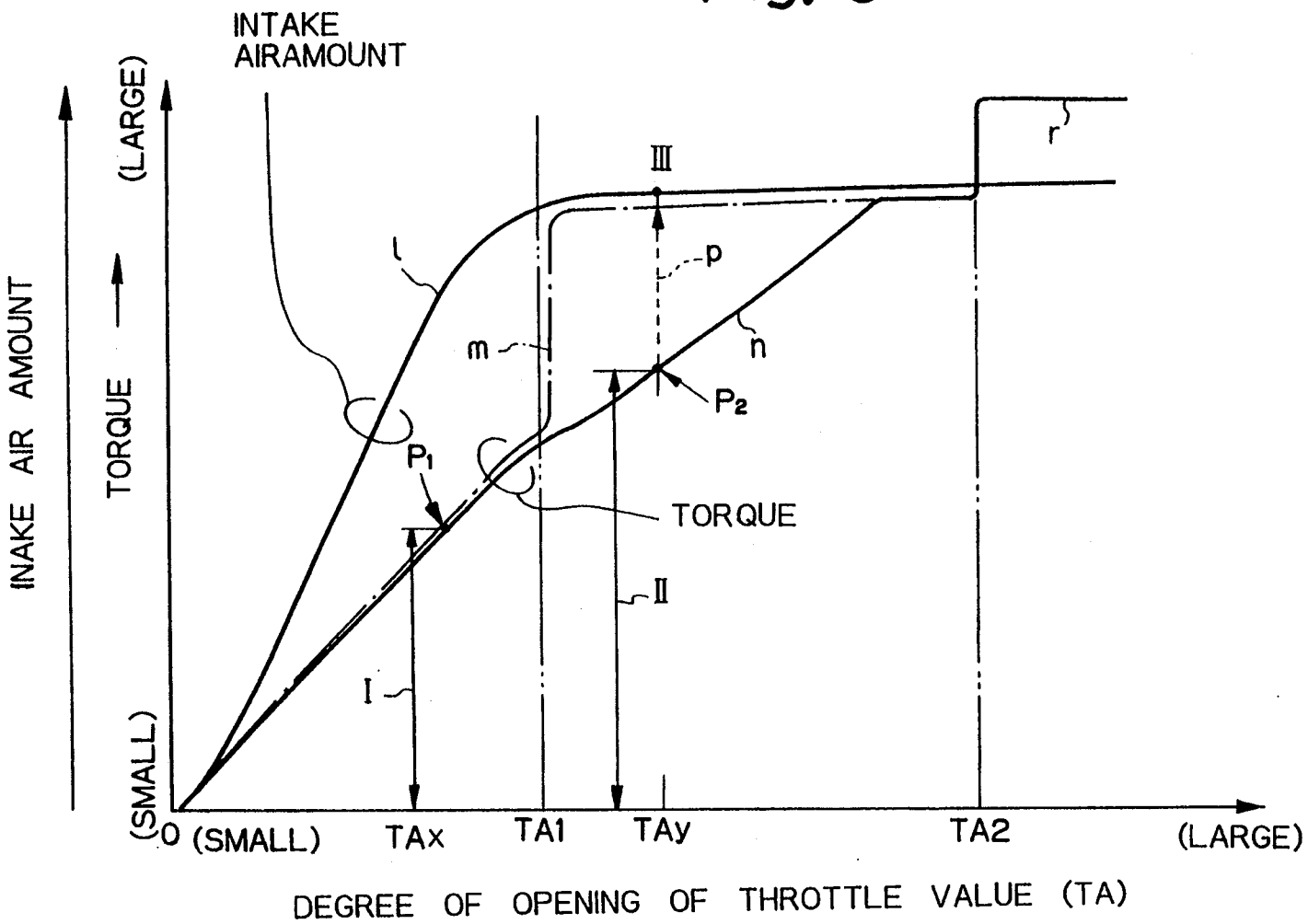
FIG. 3 illustrates relationships between the opening of the throttle valve and the intake air amount and engine torque with respect to the degree of opening the throttle valve.

FIG. 3 shows relationships between the degree of opening the throttle valve and the engine torque and the intake air amount during acceleration. A line 1 shows a relationship between the throttle opening TA and the intake air amount. As will be easily seen from the curve 1, an increase in the value of the throttle opening TA, if it is larger than a predetermined value TA1, can contribute to the maintenance of the value of the intake air amount, which remains substantially unchanged. In the prior art system, calculation of the lean correction factor FLEAN from the map of values of the lean correction factor FLEAN with respect to combinations of values of intake pressure PM and engine speed NE is canceled when the degree of opening TA the throttle valve 32 is increased to the above mentioned value TA1. Thus, the air fuel ratio at the area of the degree of opening TA of the throttle valve 32 larger than the above mentioned value TA1 is set to the theocratical air fuel ratio, which changes the engine torque as shown by a curve m. The curve m shows that the engine torque increases rapidly from the value at the lean zone to the value at the theoretical air fuel ratio when the degree of opening TA the throttle valve 32 increases to the value TA1 where the setting of the air fuel ratio is switched from the lean setting to the theoretical air-fuel ratio setting. Such a rapid increase in engine torque generates a shock in the engine, which should be avoided. In view of this, the Japanese Un-Examined Patent Publication (kokai) 3-242442 proposes an idea where an additional map of values of a lean correction factor FLEAN with respect to combinations of values of throttle opening TA and engine speed NE. From this TA-NE map for the lean correction factor FLEAN, a value of the lean correction factor FLEAN, which allows it to increase from the value TA1 of the value of the throttle opening TA, irrespective of the fact that the value of the intake air amount is substantially maintained at the region of the degree of the opening of the throttle value larger than TA1. Such a switching of the map for calculation of the lean correction factor FLEAN between the PM-NE map and the TA-NE map can increase the engine torque as shown by a curve n even above the degree of the throttle valve opening TA larger than TA1. In FIG. 3, at a full load region the throttle valve opening TA is larger than TA1. In FIG. 3, at a full loped region of the throttle opening TA is larger than TA2, thus a rich air fuel mixture of the air fuel ratio that is smaller than the theoretical air fuel ratio is obtained, which causes the engine torque to further increase as shown by a line r.

Figure 4:
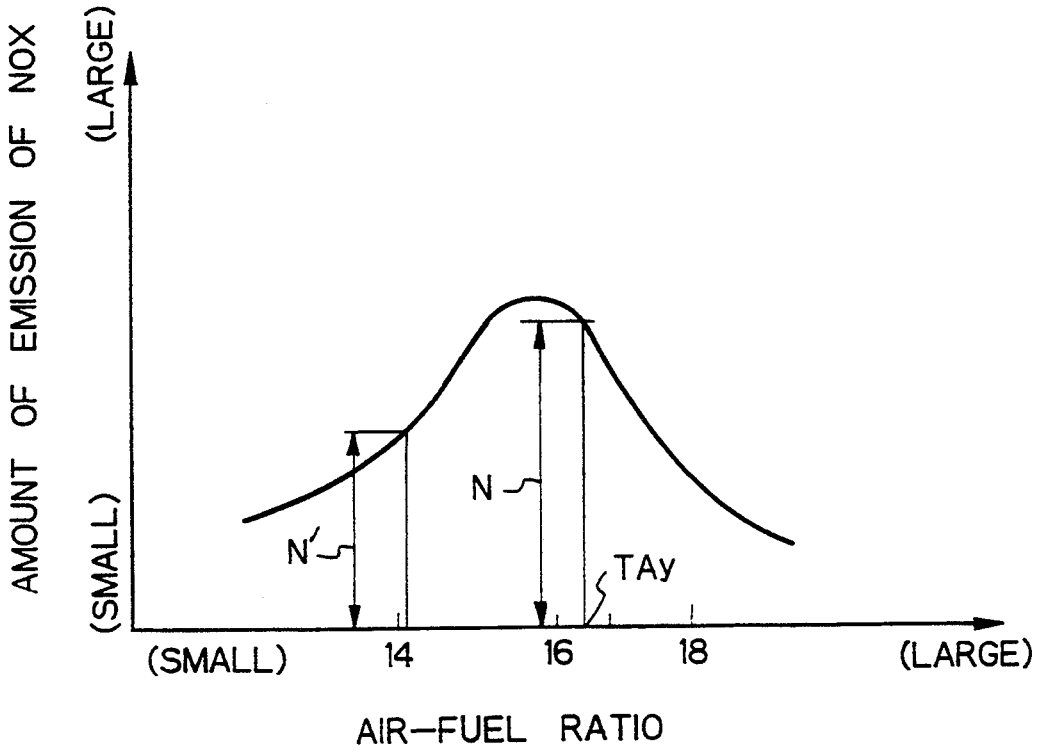
FIG. 4 illustrates a relationship between a value of the air fuel ratio and an amount of NOx emission.

In addition to the above mentioned basic control of the air fuel ratio, according to the embodiment as explained herewith, improved control of an air-fuel ratio is provided when the engine remains at the medium air fuel ratio zone 2 in FIG. 2. Namely, the engine continues to operate in the medium lean air mixture zone 2 in FIG. 2, the air fuel ratio is controlled so that it is gradually moved to the theoretical air fuel ratio in accordance wit the lapse of time after the engine enters the medium lead air mixture zone 2. Namely, as already explained, at this zone 2, the setting of the air-fuel ratio is in a range between about 16.0 to about 18.0. However, such a range of air-fuel ratio produces, as shown in FIG. 4, a relatively large amount of nitrogen oxide emission in the exhaust gas. As a result, prolonged operation of the engine at this zone 2 of the medium lean air fuel mixture can generate an amount of exhaust gas larger than a maximum value as regulated. Namely, suppose that the accelerator pedal is depressed from a position $P_1$ corresponding to a value $TA_x$ of the degree of opening the throttle valve 32 located in the ultra lean air-fuel mixture zone 1 to obtain a torque I, to a position $P_2$ corresponding to a value $TA_y$ of the degree of opening the throttle valve 32 located in the medium lean air-fuel mixture zone 2 to obtain a torque II. In the prior art, in such a situation where the engine remains in a position such as $P_2$ in the zone 2, the air-fuel ratio maintains a value located in the zone 2 in FIG. 2 corresponding to the throttle opening $T_y$, causing a large amount N of nitrogen oxide to be generated as shown in FIG. 4. In order to obviate this difficulty, according to the present invention, when the engine remains in a position such as $P_2$ in the zone 2, the value of the lean correction factor FLEAN is corrected so that it gradually changes from the mapped value at the throttle opening $TA_y$ toward the theoretical air-fuel ratio, which causes the engine torque to gradually increase to the value of III obtained by the theoretical air-fuel ratio, as shown by a dotted line p. Such control of the air-fuel ratio can reduce the emission of nitrogen oxide owing to the fact that the amount of the nitrogen oxide emission is as small as N' at the theoretical air-fuel ratio (about 14.0) as shown in FIG. 4.

In FIG. 2, a line q shows where the swirl control valve 42 is moved from a closed position to an opened position. This line q is located in the zone 3, where the theoretical air-fuel ratio is obtained. Namely, at the engine speed NE and the throttle opening TA smaller than the values of the engine speed NE and the throttle opening TA on the line q, the swirl control valve 42 is in a closed position to obtain a swirl movement of the intake air introduced into the cylinder of the engine. Contrary to this, at an engine speed NE and a throttle opening TA larger than the values of the engine speed NE and the throttle opening TA on the line q, the swirl control valve 42 is in an opened position to cancel the swirl movement of the intake air introduced into the cylinder of the engine.

Figure 5:
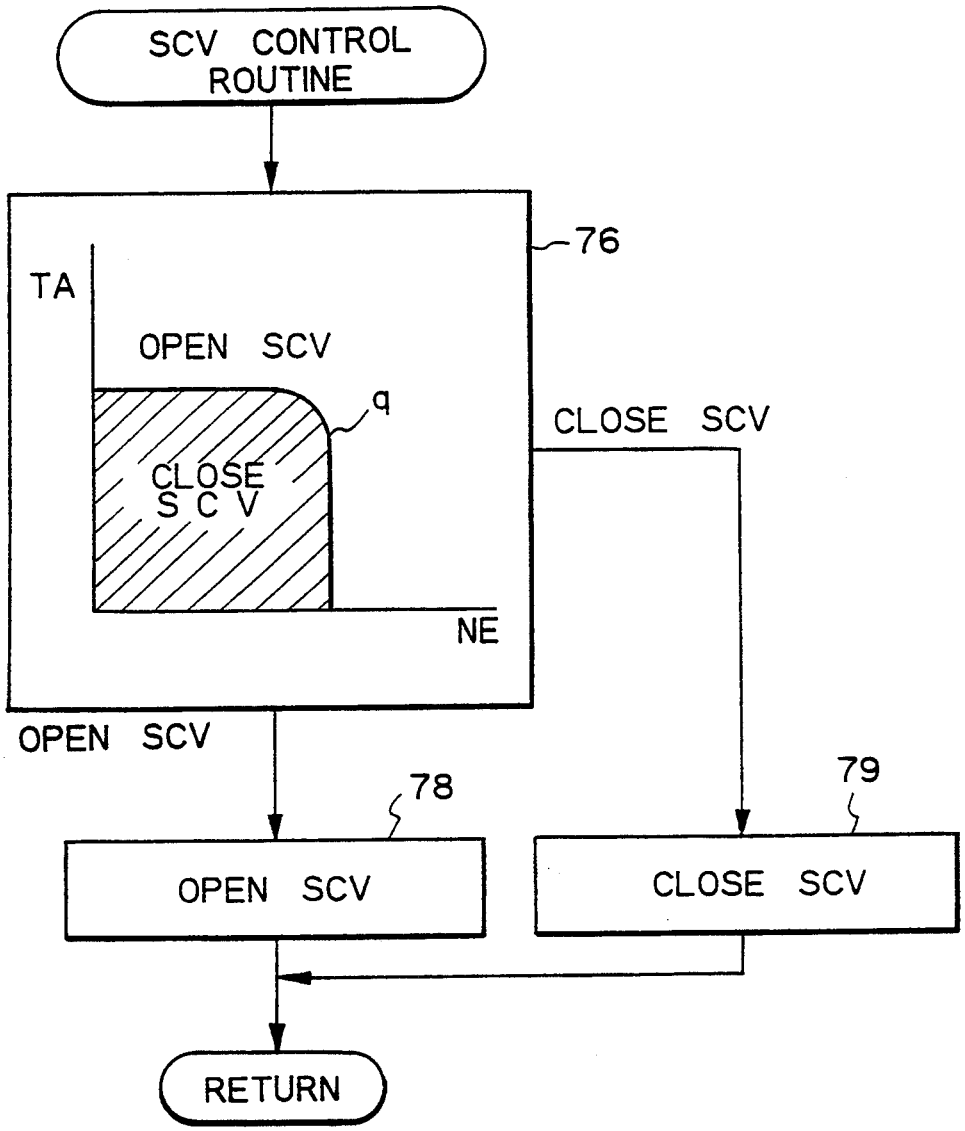
FIG. 5 to 7 are flow charts illustrating the operation executed at the control circuit in FIG. 1.
Figure 6:
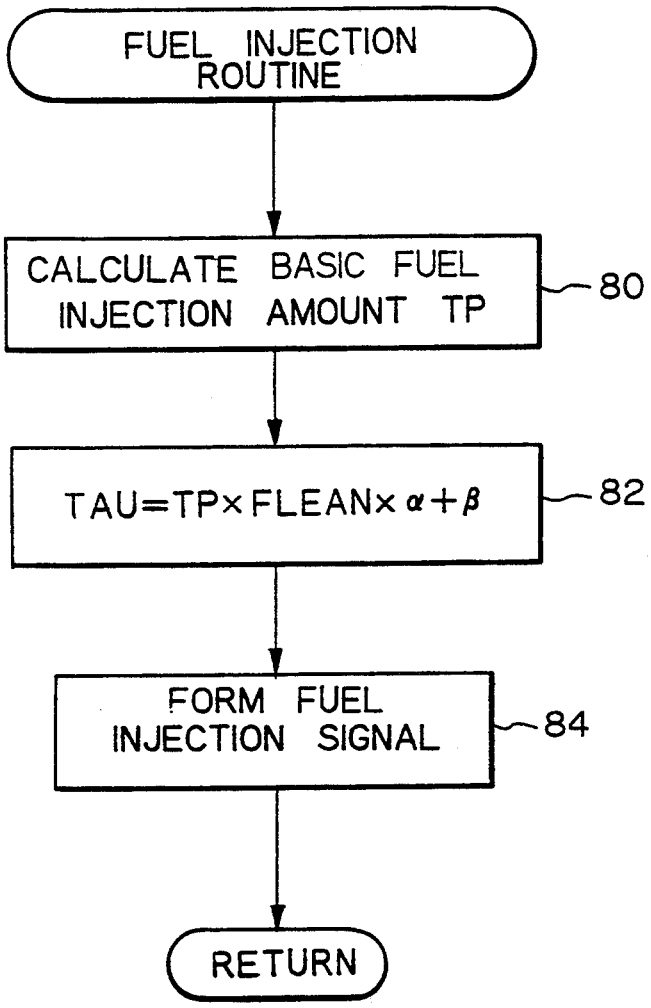
Figure 7:
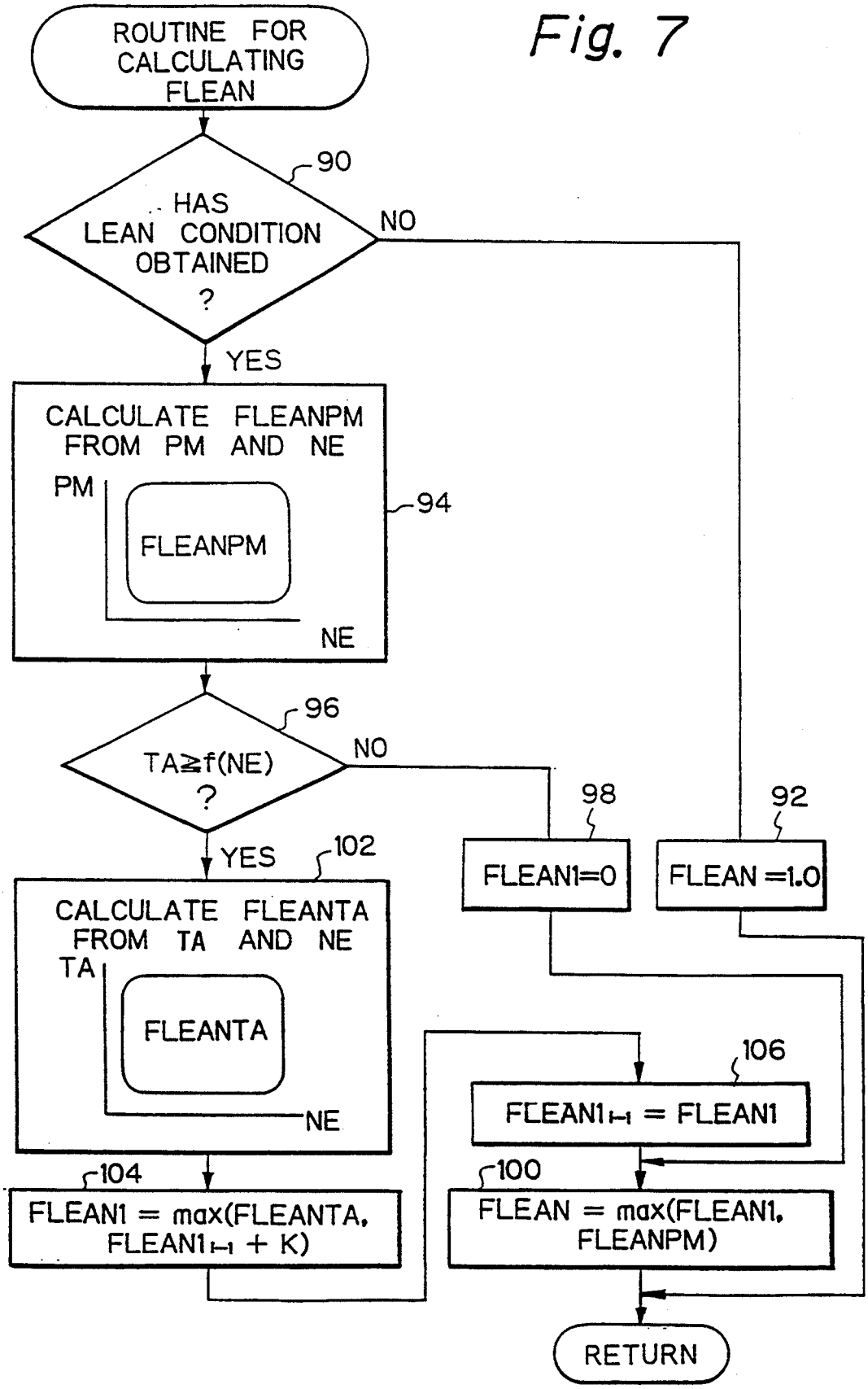

FIGS. 5, 6 and 7 are flowcharts illustrating how the control circuit 64 in FIG. 1 operates. FIG. 5 schematically illustrates a flow chart of a routine for controlling the swirl control valve (SCV) 42, which is effected for a predetermined constant time period. At step 76, it is determined whether the swirl control valve 42 is opened or not. As explained with reference to FIG. 2, the swirl control valve 42 is, basically, open when the engine rotational speed NE and the degree of opening TA the throttle valve 32 are outside the line q, i.e., larger than values of the engine speed NE and the degree of the opening TA on the line q. At this step, its determined, whether the engine speed NE and throttle opening TA as detected by the sensors 66 and 70 is larger than values of the engine speed NE and the degree of the opening TA on the line q, respectively. A map for determination of the condition of the swirl control valve 42 is provided, and when it is determined that the detected engine speed NE and the degree of the opening TA is in the area outside the line q, it is determined that the swirl control valve 42 should be opened, and the routing goes from step 76 to step 78, where a signal is issued to the electromagnetic valve 50 so that the atmospheric air pressure from the air filter 54 is opened to the diaphragm 46A, causing the swirl control valve 42 to open thereby preventing the occurrence of a swirl movement of the air in the cylinder bore 12. Contrary to this, when it is determined that the detected engine speed NE and the degree of the opening TA is in the area inside the line q, it is determined that the swirl control valve 42 should be closed, and the routing goes from step 76 to step 79, where a signal is issued to the electromagnetic valve 50 so that a vacuum pressure at the vacuum port 52 at the surge tank 30 is opened to the diaphragm 46A causing the swirl control valve 42 to be closed so as to create a swirl movement of the intake air in the cylinder bore 12 of the engine body 10.

FIG. 6 shows, schematically, a routine for executing a fuel injection from the respective fuel injector 34. This routine is executed at timings sufficiently early to calculate the injection fuel amount for a fuel injection from the respective fuel injection 34 of the cylinder. The determination of the fuel injection timing as is well known to those skilled in this art, is effected by a counter that is incremented when pulse signals from the crank angle sensor 66 for every 30 degree rotation of the crankshaft arrive and is cleared when a pulse signal from the sensor 66 for every 720 degree rotation of the crankshaft arrives. At the following step 80, a basic fuel injection amount TP is calculated, which is the amount of fuel injected from the injector 34 for obtaining a theoretical air-fuel ratio of the air-fuel mixture introduced into the combustion chamber 18 at a combination of detected values of engine speed NE and intake pressure PM. As is well known, a map of values of the basic fuel injection amount TP is provided for a plurality of combinations of engine speed NE values and intake pressure PM. A map interpolation calculation is carried out to obtain a value of the basic fuel amount TP corresponding to a combination of detected values of the engine speed NE and the intake air pressure PM.

At step 82, a final fuel injection amount TAU is calculated by $$TAU = TP \times FLEAN \times \alpha + \beta,$$

where FLEAN is a lean correction factor having a positive value smaller than 1.0, and $\alpha$ and $\beta$ generally illustrate a correction factor and correction amount for obtaining corrections of the fuel injection amount in accordance with various actual requirements, such as acceleration enrichment or starting enrichment, which are omitted as they are not directly related to the present invention.

At step 84, a process for forming fuel injection signals is executed so that fuel injectors 34 are operated for a period to obtain the fuel injection amount TAU calculated at the step 82.

FIG. 7 illustrates a routine for calculating the lean correction factor FLEAN, which is carried out for shaft periods, such as 10 milliseconds. At step 90, it is determined that the engine is now in a condition for operating under a lean air-fuel mixture. As can be easily understood, the lean air-fuel mixture is not obtained when the engine load in high (zone 3 in FIG. 2) or when the engine is operating such that a start-up enrichment correction or an enrichment correction for preventing overheating of the catalytic converter is necessary. When it is determined that the engine is not operating with a lean air-fuel mixture the routine goes to step 92 where the lean correction factor FLEAN is set to 1.0, preventing the lean correction from being applied to the fuel injection amount as can be easily seen from the above equation at the step for calculating the final fuel injection amount TAU.

When it is determined at the step 90 that the engine is in a condition such that the lean correction should be done, the routine goes to step 94, where a map interpolation calculation of the lean correction factor is performed from a map of values of lean correction factor FLEANPM. This map is for obtaining an air fuel ratio at zone 1 in FIG. 2 having a value in a range between 18 to 20, where the intake air amount can increase proportionally as the degree of the opening of the throttle valve 32 increases. This map FLEANPM is constructed of positive values (<1.0) of the lean correction factor with respect to combinations of values of the intake pressure PM and the engine speed NE. A map interpolation calculation is performed to obtain a value of the lean correction factor FLEANPM corresponding to a combination of the detected values of intake pressure PM and engine speed NE. At step 96, it is determined whether a value of the degree of the opening TA of the throttle valve 32 at this instant is larger than a predetermined value f(NE), which is determined in accordance with engine rotational speed NE, which value f(NE) corresponds to a value of the degree of the opening TA of the throttle valve 32, where a switching of the zone between the ultra lean zone 1 and the medium lean zone 2 occurs. When it is determined that TA<f(NE), i.e., the engine should operate with the ultra lean air-fuel mixture, the routine goes to step 98 where a value of FLEAN1 is set to zero, the meaning of which will be explained later, and the routine then goes to step 100, where, among the values of FLEAN1 and the FLEANPM, a larger one is moved to FLEAN, which is used for calculating the fuel injection amount at step 82 in FIG. 6. When the engine is operating in the ultra lean zone 1, the value of FLEAN1=0, and therefore the FLEANPM is selected as the lean correction factor FLEAN at step 100.

When it is determined that TA≧f(NE) at step 96, i.e., the degree of the opening TA of the throttle valve 32 is in an area that is larger than the value of the TA corresponding to the boundary between the areas 1 and 2, i.e., the engine is in the medium lean zone 2 in FIG. 2, the routine goes to step 102, where a map interpolation calculation of the lean correction factor is performed from a map of values of lean correction factor FLEANTA. This map is for obtaining an air fuel ratio at zone 2 in FIG. 2 having a value in a range between 16 to 18, where the intake air amount is unchanged irrespective of increases in the degree of the opening TA of the throttle valve 32. This map FLEANTA is constructed of positive values (<1.0) of the lean correction factor with respect to combinations of values of the degree of the opening TA of the throttle valve 32 and the engine speed NE. A map interpolation calculation is performed to obtain a value of the lean correction factor FLEANTA corresponding to a combination of the detected values of the degree of the opening TA of the throttle valve 32 and the engine speed NE. At step 104, among the FLEANTA obtained at step 102 and the value of FLEAN1 obtained at the preceding cycle, $FLEAN1_{i-1}$ plus a fixed positive small value k(<<1.0), a larger one is moved to FLEAN1. In the situation where the degree of the opening of the throttle valve 32 increases, consecutively the value of the FLEANTA is larger than the value of $FLEAN1_{i-1}$ +K, and therefore the map value of the FLEANTA moves into the FLEAN1. At the following step 106, the new value of the FLEAN1 just chosen at step 104 is moved to the $FLEAN1_{i-1}$, which is used at step 104 in the following cycle, as will be fully explained later. The routine, then, goes to step 100, where, among the values of FLEAN1 and the FLEANPM, a larger one is moved to FLEAN, which is used for calculating the fuel injection amount at step 82 in FIG. 6. When the engine is operating in the medium lean zone 2, the value of FLEAN1 calculated based on the map FLEANTA is larger than the value calculated on the PM map FLEANPM. Thus, the value of the lean correction factor calculated based on TA map (FLEANTA) is selected as the lean correction factor FLEAN at step 100. Thus, a desired increase in the torque as shown by the line n is obtained in accordance with an increase acceleration.

Figure 8B:
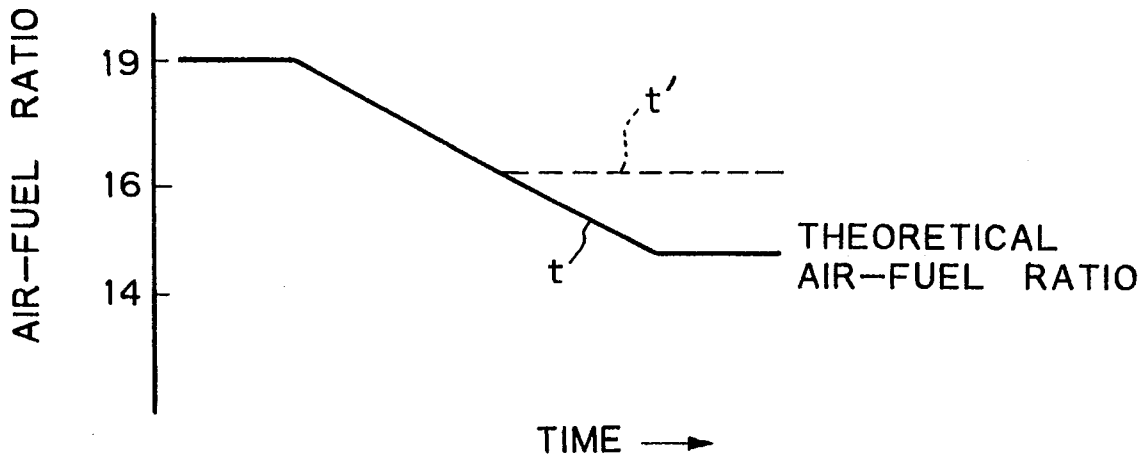

In a situation where, as shown by FIG. 8-(a), the engine remains operating at a point (for example, a point $P_2$ in FIG. 3) in the area 2 by depression of the accelerator pedal so that the degree of the opening TA of the throttle valve 32 is larger that the predetermined value TA1 as shown by a line S in FIG. 8-(A), the value of $FLEAN1_{i-1}$ is incremented for k every time the routine in FIG. 7 is executed. Thus, at step 104, the value of the $FLEAN_{i-1}$ +K is moved to FLEAN1, which is naturally selected as FLEAN at step 100. As a result, so long as the engine remains at the point $P_2$, the value of the lean correction factor FLEAN is incremented for K, every time the routine in FIG. 7 is executed, causing the air fuel ratio to increase toward the theoretical air fuel ratio, as shown by a line t in FIG. 8-(B). Such enrichment control of the air fuel ratio toward the theoretical air fuel ratio when the engine remains at the point $P_2$ of zone 2, where the engine is operating with a medium lean air-fuel mixture, can prevent the air fuel ratio from being controlled to a value to provide a large amount of NOx, which is desirable from the view point of suppression of the amount of NOx component in the exhaust gas. It should be noted that the execution of the step 104 does not allow the value of the lean correction factor FLEAN to be larger than the value of 1.0 due to a gurd roatine (not shown). Contrary to this, in the prior art, in the situation where the degree of the throttle valve opening is maintained at a value in the medium lean zone 2, as shown by the line S in FIG. 8-(A), the air fuel ratio remains unchanged as shown by a dotted line t' in FIG. 8(B), causing a large amount (N in FIG. 4) of the NOx component to be produced in the exhaust gas. According to the present invention, the air fuel ratio moves to the theoretical air fuel ratio when the degree of the opening TA of the throttle valve 32 remains at a value in the zone 2, as shown by the line s in FIG. 8-(A), which allows the emission of NOx to be finally reduced to the level N' in FIG. 5.

The value of f(NE) is a value of the degree of the opening TA of the throttle valve 32, above which the intake air is not substantially increased irrespective of an increase of the degree of the opening of the throttle valve 32. The value of f(NE) is dependent from the rotational speed of the engine. Namely, in a range of the rotational speed, the value of f(NE) is increased in accordance with an increase in the engine speed NE. Namely, FIG. 9 shows relationships between the TA and the intake air amount Q (or an intake air amount -engine speed ratio, Q/N) for various values of engine speed NE. As will be easily seen, the value of TA from which the increase in the intake air amount Q is blunted is a, b(>a) and c(>b), when the engine speed NE is 800, 1600 and 2,400 rpm, respectively.

In the flow chart of FIG. 7, the value of k determines the speed of the increase (degree of inclination of the curve t in FIG. 8-(B)) in fuel enrichment when the engine remains at the point in the medium lean zone 2. The desired setting of the value of k is such that the lower the engine speed NE, the larger the value of k. Namely, in FIG. 10, a line L is a standard load line when the vehicle with a five speed transmission is operating in the fifth gear. During acceleration, depression of the accelerator pedal commences from a position on the line L, and when the acceleration commences from a point A of the load line L having a lower engine speed NE in the ultra lean zone 1 toward a point B in the medium lean zone 2, the degree of depression of the accelerator pedal is large, and therefore, following depression of the accelerator pedal to the point B, the intention of the driver to accelerate is still strong, resulting in the large increase speed valve k. Contrary to this, during acceleration from a point C having an higher engine speed, the degree of depression of the accelerator pedal is itself small, and therefore, after completion of depression of the accelerator pedal to the point D, the degree of residual intent to accelerate is small, thereby making a small increase speed value k in the fuel enrichment correction suitable to driver. It should be noted that a map for calculation of the value of k is provided in the memory of the control circuit 64, and a map interpolation calculation is done to obtain a value of k corresponding to the value of the engine speed NE at a particular instant.

It is conceivable to use a single map throughout the ranges 1 and 2 of the lean correction factor valves FLEAN with regard to combinations of the degree of opening valves TA of the throttle valve and the engine speed NE. Namely, unlike the embodiment where the intake pressure PM map is used at the region 1, the TA map is used not only for region 2 but also for region 1. The value of the lean correction factor FLEAN calculated by the TA map will be affected by the atmospheric pressure, causing the precision of the value of the lean correction factor FLEAN to be reduced. Namely, an inevitable change in atmospheric pressure causes the intake air amount to correspondingly change even if the degree of the opening TA of the throttle valve and the engine speed NE remain unchanged. Thus, a value of the lean correction factor FLEAN changes slightly from a desired value. Such a small change may adversely affect stable combustion of the engine because the engine is operating under an ultra lean air-fuel mixture. Furthermore, at the region of the degree TA of the opening of the throttle valve 32, a small change in the value of TA changes the intake air amount significantly thereby lowering the precision of the control of the air fuel ratio. Thus, switching between the PM map and a TA map, as in the embodiment, is preferable for obtaining a precise control of the air fuel ratio. However, if such a disadvantage is acceptable, a single TA map construction throughout the total lean combustion range can be employed.

FIGS. 11 and 12 show a lean correction factor calculation routine in a second embodiment of the present invention. In this second embodiment, a second intake pressure PM map is provided for calculating the lean correction factor based on the intake pressure PM at the medium lean zone 2, where the engine speed is high and the degree of the opening TA of the throttle valve 32 is small. Namely, at a zone 4 having a high engine speed and a small throttle opening in the zone 2 as illustrated by a crossed shaded line and shown in FIG. 13, it is not desirable to calculate the lean correction factor from the TA map because the intake air amount changes substantially in accordance with an increase in the throttle opening TA. Thus, in addition to a first map FLEANPM1 corresponding to the map FLEANPM in the first embodiment, a second map FLEANPM2 is provided for calculating the lean correction factor in accordance with the intake pressure PM and the engine speed NE.

The routine in FIGS. 11 and 12 is executed similar to FIG. 7 in the first embodiment for every 10 millisecond period. At step 120, it is determined whether a condition for obtaining the lean air-fuel mixture is obtained, and when the lean condition is not obtained the routine goes to step 122, where the lean correction factor FLEAN is set to 1.0 for preventing the lean air-fuel mixture from being obtained.

When the lean condition is obtained at step 120, the routine goes to step 121, where a lean correction factor is calculated from the first PM map FLEANPM1, which is, as explained above, the same as the map FLEANPM at step 94 in FIG. 7. Namely, the interpolation calculation is executed to calculate a value of the lean correction factor FLEANPM1 corresponding to a detected combination of the intake pressure PM and the engine speed. At step 124, it is determined that the degree of the opening TA of the throttle valve 32 is larger than a desired value f'(NE) calculated in accordance with the engine speed NE. This value f'(NE) is shown by a line V in FIG. 13. Namely, the line V is along the boundary between the ultra lean zone 1 and the medium lean zone 2 up to a rotational speed $NE_x$, and then corresponds to the upper limit of the zone 4. When the throttle opening TA is larger than the f'(NE), the routine goes to step 126, where a map interpolation calculation of a lean correction factor is calculated based on the TA map FLEANTA similar to step 102 is FIG. 7. At step 128, among the values of the FLEANTA obtained at step 102 and the calculated value of FLEANST at step 128 during the preceding cycle, $FLEANST_{i-1}$ plus a fixed positive small value k ($<<1.0$), a larger value as FLEANST is chosen. When the throttle opening TA is smaller than the f'(NE), the routine goes to step 132, where a map interpolation calculation of a lean correction factor is calculated based on the second PM map FLEANPM2. Namely a map interpolation calculation is executed so as to obtain a value of FLEANPM2 corresponding to a detected combination of intake pressure PM and engine speed, similar to step 102 in FIG. 7. At step 134, among the values of the FLEANPM2 obtained at step 132 and the calculated value of FLEANST during the preceding cycle, $FLEANST_{i-1}$ plus a fixed positive small value KFL($<<1.0$), a larger value than FLEANST is chosen. Step 128 or 134 is for gradually decreasing the air fuel ratio toward the theoretical air fuel ratio when the engine remains at a position in the medium lean zone 2, similar to step 104 in FIG. 7 for preventing the emission of NOx from increasing.

After step 128 or 134, the routine goes to step 136 where the calculated value FLEANST moves to the $FLEANST_{i-1}$ for the following cycle (steps 128 or 134). At step 138 it is determined whether the value of FLEANST is larger than 1.0. When FLEANST $>1.0$, the routine goes to step 140 where a value 1.0 moves to $FLEANST_{i-1}$. These steps are for ensuring that value of the FLEANST will not be larger than 1.0.

At step 142, among the values of the FLEANST obtained at step 128 or 132 and FLEANPM1 at step 121, a larger value is moved to FLEAN, which is used for obtaining a fuel injection fuel amount at step 82 in FIG. 6. At the ultra lean zone 1, the PM maps FLEANPM1 (step 121) and FLEANP2 (step 132) have the same values, thus the ultra lean air-fuel mixture is obtained, similar to the first embodiment in zone 1. At zone 2, the TA map FLEANTA is selected at step 126, and therefore a medium lean air-fuel mixture is obtained when the degree of the opening of the throttle valve TA is larger than the predetermined value f' (NE). At the medium lean zone 2 having a lower TA value and of higher engine speed value NE at region 4, the PM maps FLEANPM2 is selected at step 132. Finally, when the engine remains at a point in zone 2 having a larger TA value, the value of the lean correction factor FLEANST is incremented for k for every cycle for decreasing the air fuel ratio toward the theoretical air fuel ratio. Namely, $FLEANST_{i-1}+K$ is chosen at step 128. Contrary to this, when the engine remains at a point in the medium lean zone 4 having a smaller TA value, the value of the lean correction factor FLEANST is incremented for KFL for every cycle for decreasing the air fuel ratio toward the theoretical air fuel ratio. Namely, $FLEANST_{i-1}+KFL$ is chosen at step 134.

While embodiments of the present invention are explained with reference to the attached drawings, many modifications and changed can be made by those skilled in this art without departing from the scope and spirit of the present invention.

I claim:

1. An intake system for an internal combustion engine, comprising:

an intake passageway for introducing intake air into the engine;

a throttle valve arranged in the intake passageway for controlling an amount of intake air introduced into the engine;

a fuel supply device for supplying a fuel which, together with the intake air, constitute an air-fuel combustible mixture that is introduced into the engine for combustion therein;

means for setting a desired air fuel ratio of the air-fuel combustible mixture introduced to the engine, and;

mean for controlling an amount provided by the fuel supply device so as to achieve the air fuel ratio set by the setting means, the setting means comprising:

means for detecting a load acting on the engine;

first setting means for setting the air fuel ratio to an ultra lean air fuel ratio when a low load is acting on the engine so that the emission of nitrogen oxide components in exhaust gas output from the engine is small;

second setting means for setting the air fuel ratio to a medium lean air fuel ratio when a medium load is acting on the engine;

third setting means for setting the air fuel ratio to a third air fuel ratio when the load acting on the engine is larger than the medium load, wherein the third air fuel ratio is an air fuel ratio other than a lean air fuel ratio;

the medium lean air fuel ratio set by the second setting means being less than the ultra lean air fuel ratio set by the first setting means and greater than the theoretical air fuel ratio set by the third setting means, and the medium lean air fuel ratio being reduced in accordance with an increase in the engine load;

means for selecting one of the first, second and third setting means based on the load detected by the load detecting means; and means for gradually reducing the air fuel ratio toward an air fuel ratio other than the lean air fuel ratio when the engine operates under the medium lean air fuel ration for a prescribed period of time.

2. An intake system according to claim 1, wherein the reducing means decreases the value of the air fuel ratio obtained by the second setting means by a fixed amount after every lapse of a predetermined time period after the engine begins operating under the medium lean air fuel ratio.

3. An intake system according to claim 1, wherein the selecting means selects an intermediate setting between the first setting means and the second setting means, wherein the intermediate setting provides a smaller air fuel ratio than the medium lean air fuel ratio set by the second setting means.

4. An intake system according to claim 1, comprising:

means for calculating a basic fuel amount corresponding to a theoretical air fuel ratio based on the load acting on the engine, wherein the first setting means sets a first correction factor for correcting the basic fuel amount so as to obtain the ultra lean air fuel ratio;

wherein the second setting means sets a second correction factor for correcting the basic fuel amount so as to obtain the medium lean air fuel ratio.

5. An intake system according to claim 1, further comprising:

means for detecting intake pressure of the engine;

means for detecting engine speed; and means for detecting a degree of opening of the throttle valve;

wherein the first setting means comprises:

a first map of first correction factors for correcting the air fuel ratio in accordance with combinations of the intake pressure and the engine speed; and a first interpolating means for calculating from the first map the correction factor corresponding to the detected intake pressure and the engine speed; and wherein the second setting means comprises:

a second map of second correction factors for correcting the air fuel ratio in accordance with combinations of the degree of the opening of the throttle valve and the engine speed; and a second interpolating means for calculating from the second map the correction factor corresponding to the detected degree of the opening of the throttle valve and the engine speed.

6. An intake system according to claim 5, further comprising:

means for allowing the map interpolation by the first interpolation means to be executed when the degree of opening of the throttle valve is smaller than a predetermined value, the predetermined value being determined in accordance with the engine speed; and means for allowing the map interpolation by the second interpolation means to be executed when the degree of opening of the throttle valve is larger than the predetermined value.

7. An intake system according to claim 6, wherein the reducing means comprises:

storing means for storing a correction factor during a cycle of the engine;

summing means for incrementing the correction factor stored in the storing means by a fixed value during a succeeding cycle of the engine; and choosing means for selecting either the correction factor calculated by the second interpolation means or the incremented correction factor output by the summing means depending on which one produces a smaller air fuel ratio.

8. An intake system according to claim 5, wherein the second setting means further comprises:

a third map of third correction factors for correcting the air fuel ratio in accordance with combinations of the intake pressure and engine speed, the third map being used to obtain an air fuel ratio when the engine is operating at high engine speeds and the degree of the opening of the throttle valve is small;

a third interpolating means for calculating from the third map the correction factor corresponding to a combination of the detected intake pressure and the engine speed; and second selecting means for selecting the correction factors obtained from the second map or the correction factors obtained from the third map depending on which correction factor produces a smaller air fuel ratio.

9. An intake system according to claim 8, wherein the second selecting means selects the second map when the degree of the opening of the throttle valve is larger than a predetermined value, the predetermined value being determined in accordance with the engine speed, and the second selecting means selects the third map when the degree of the opening of the throttle valve is smaller than the predetermined value.

10. An intake system according to claim 9, wherein the reducing means comprises:

first modifying means operating when the second map is selected, the first modifying means comprising:

first storing means for storing a first correction factor during a cycle of the engine;

first summing means for incrementing the first correction factor stored by the first storing means by a first fixed value during a succeeding cycle of the engine; and first choosing means for selecting either the first correction factor calculated by the second interpolation means or the incremented correction factor output by the first summing means depending on which one produces a smaller air fuel ratio; and second modifying means operating when the third map is selected the second modifying means comprising;

second storing means for storing a second correction factor during a cycle of the engine;

second summing means for incrementing the correction factor stored by the second storing means by a second fixed value during a succeeding cycle of the engine; and second choosing means for selecting either the second correction factor calculated by the third interpolation means or the incremented correction factor output by the second summing means depending on which one produces a smaller air fuel ratio.

* * * * *